US006802543B1

(12) United States Patent
Wakefield

(10) Patent No.: US 6,802,543 B1
(45) Date of Patent: Oct. 12, 2004

(54) DOOR HANDLE

(75) Inventor: Stephen E. Wakefield, Tulsa, OK (US)

(73) Assignee: AAON, Inc., Tulsa, OK (US)

( * ) Notice: Subject to any disclaimer, the term of this patent is extended or adjusted under 35 U.S.C. 154(b) by 0 days.

(21) Appl. No.: 10/280,234

(22) Filed: Oct. 25, 2002

(51) Int. Cl.[7] ..... E05C 9/16

(52) U.S. Cl. ..... 292/48; 292/11; 292/26; 292/56; 292/196; 292/DIG. 68

(58) Field of Search ..... 292/48, 26, 196, 292/DIG. 68, 56, 11

(56) References Cited

U.S. PATENT DOCUMENTS

| | | | | | |
|---|---|---|---|---|---|
| 1,740,827 | A | * | 12/1929 | Mayea | 292/48 |
| 1,774,783 | A | * | 9/1930 | Worley et al. | 70/82 |
| 1,909,847 | A | * | 5/1933 | Rand | 312/332.1 |
| 1,909,848 | A | * | 5/1933 | Rand | 312/218 |
| 2,233,028 | A | * | 2/1941 | O'Connor | 292/19 |
| 2,242,958 | A | * | 5/1941 | O'Connor | 292/19 |
| 2,732,240 | A | * | 1/1956 | Hutzelman | 292/175 |
| 3,862,772 | A | * | 1/1975 | Latham | 292/36 |
| 3,958,821 | A | * | 5/1976 | Scalera | 292/97 |
| 4,067,599 | A | * | 1/1978 | Ohno | 292/356 |
| 4,095,829 | A | * | 6/1978 | Van Klompenburg | 292/241 |
| 4,303,286 | A | | 12/1981 | McClellan | |
| 4,477,130 | A | | 10/1984 | Frantz | |
| 5,150,934 | A | * | 9/1992 | Grody | 292/288 |
| 5,209,168 | A | | 5/1993 | Chapron et al. | |
| 5,308,126 | A | * | 5/1994 | Weger et al. | 292/53 |
| 5,373,716 | A | | 12/1994 | MacNeil et al. | |
| 5,595,076 | A | | 1/1997 | Weinerman et al. | |
| 5,775,745 | A | | 7/1998 | Hoppe et al. | |
| 5,794,472 | A | * | 8/1998 | Kester et al. | 70/472 |
| 5,911,763 | A | | 6/1999 | Quesada | |
| 6,010,094 | A | * | 1/2000 | Csik et al. | 244/129.1 |
| 6,062,616 | A | * | 5/2000 | Smolarski | 292/356 |
| 6,079,585 | A | * | 6/2000 | Lentini | 220/324 |
| 6,101,764 | A | * | 8/2000 | Guy-Paul | 49/395 |
| 6,116,807 | A | | 9/2000 | Dzurko et al. | |
| 6,161,881 | A | * | 12/2000 | Babka et al. | 292/26 |
| 6,334,560 | B1 | * | 1/2002 | Lentini | 224/404 |
| 6,354,119 | B1 | | 3/2002 | Molzer | |
| 6,502,868 | B1 | * | 1/2003 | Laspa et al. | 292/26 |
| 6,527,314 | B2 | * | 3/2003 | Brown | 292/336.3 |
| 2002/0070561 | A1 | | 6/2002 | Welsh et al. | |
| 2002/0121785 | A1 | | 9/2002 | Fisher | |

* cited by examiner

*Primary Examiner*—Daniel P. Stodola
*Assistant Examiner*—Carlos Lugo
(74) *Attorney, Agent, or Firm*—Molly D. McKay

(57) ABSTRACT

A door handle system for a door employing a plurality of door handles that operate in unison. Each door handle comprised of a lever with a perpendicular shaft, and the shaft extending through sequentially and securing together the following additional elements of the door handle to insure that the latch mechanism rotates together with the lever: a sealing washer, snap bushing, handle opening through the door, second bushing, collar and latch mechanism. An arm provided on each latch mechanism that attaches to a common bus bar. An outwardly extending tongue provided on each latch mechanism for engaging either a door facing or a tongue receiving bracket attached to the door facing to latch the door in a closed position. A lock bracket on the door with a lock opening to align with a lock opening provided the lever for padlocking the lever closed.

2 Claims, 7 Drawing Sheets

DOOR HANDLE

BACKGROUND OF THE INVENTION

1. Field of the Invention

The present invention relates to a door handle system that employs a plurality of levers for simultaneously latching and unlatching a plurality of associated latch mechanisms provided on a door. This door handle system employs varying numbers and placement of levers and associated latch mechanisms, can be installed on doors that open to the inside or on doors that open to the outside, can be used on either left or right hand opening doors, can be operated from either side of the door, and can be locked by employing a single padlock in association with only one of the levers of the system.

2. Description of the Related Art

Most of the door handle systems that are currently employed utilize only one latch mechanism to hold the door shut. One latch mechanism holds the door to the door frame in only one location. For use with doors that are flexible and can be easily warped, such as metal doors, it is desirable to employ door handle systems with more than one latch mechanism so that various points on the door can be held to the door frame.

Various multiple latch door handle systems have been proposed. However, each of these multiple latch door handle systems has one or more problems associated with its installation or use.

Some of the multiple latch door handle systems have a number of latch mechanisms that work independently. These systems are time consuming to open and close because each latch mechanism must be operated individually in order to open or close the door.

Other multiple latch door handle systems employ latch mechanisms that work in conjunction with each other, but are designed so that the latch mechanisms must be located at a certain point and distance from the other latch mechanisms in the system. Installation of these systems can be time consuming, and often the locations of the latch mechanisms are not convenient for the door onto which they are to be installed.

Still other multiple latch door handle systems are complicated in operation and may employ latch mechanisms that are directed in opposite directions from each other. Again, installation for these types of systems is complicated and time consuming. The systems are not flexible enough for installation on different types or sizes of doors, on both left and right hand opening doors, or for inside and outside opening doors without making major modifications to the hardware. These systems often employ complicated linking mechanisms with numerous parts that can break. Once a part is broken on one of these systems, they are often hard to repair.

Some multiple latch door handle systems are designed for installation on only one side of a door, i.e. either a right handed opening door or a left handed opening door. And most of these multiple latch door handle systems can not be opened from both sides of the door, i.e. opened from both the front side and back side of the door and can not be used on both inside opening doors and on outside opening doors.

Also, many of these multiple latch door handle systems are difficult or impossible to lock so that all of the latch mechanisms of the system remain locked in a latched position.

The present invention addresses all of these problems by providing a simple, multiple latch door handle system for simultaneously latching and unlatching a plurality of associated latch mechanisms provided on a door. The present door handle system is easy to install, allows flexibility in the number of levers and latch mechanisms employed, and allows flexibility in the distance that the levers and latch mechanisms are spaced apart from each other. This system can be installed either an inside opening door or on an outside opening door, can be used on either a left hand opening door or a right hand opening door, and can be operated from either side of the door. Also, all of the latch mechanisms of this door handle system can be locked in a latched position by employing a single padlock in association with the distal end on just one of the levers of the system.

SUMMARY OF THE INVENTION

The present invention is a door handle system that employs a plurality of levers for simultaneously latching and unlatching a plurality of associated latch mechanisms provided on a door. This system is mounted externally on the door to the surface of the door and to the surface of the door frame so that the entire system is readily visible and accessible for operation and repair.

Each lever is paired with and attached to an associated latch mechanism so that the latch mechanism rotates in conjunction with its associated lever. Each lever is provided with a shaft that is provided on a proximal end of the lever. The shaft extends outward from the lever so that a longitudinal axis of the shaft is approximately perpendicular to a longitudinal axis of the lever. Two opposite sides of the shaft are flattened along the length of the shaft so that items that are fitted to the shaft, i.e. are provided with openings therein having two flattened sides to the opening, and are slipped over a distal end of the shaft will not be able to rotate relative to the shaft, but those items will rotate in conjunction with rotation of the shaft and its associated lever.

A groove is provided in the proximal end of the lever so that the groove surrounds the shaft. A compressible washer slips over the distal end of the shaft and is received in the groove to seal the lever to the door in order to prevent air leakage between the door and the lever.

Next, a hollow snap bushing is placed over the distal end of the shaft so that a cylindrical end of the snap bushing faces away from the lever. The opposite end of the snap bushing is provided with a shoulder which has a larger diameter than the diameter of the cylindrical end. Then the shaft is inserted through an opening provided in a door for this purpose, and the cylindrical end of the snap bushing enters the opening and is secured therein by wings that are provided on the cylindrical end, with the shoulder resting against the front surface of the door.

After the shaft has been inserted through the opening in the door, a hollow second bushing inserts over the distal end of the shaft so that a cylindrical portion of the second bushing extends through the opening in the door. The second bushing is provided with a shoulder that is larger in diameter than its cylindrical portion, and this shoulder engages the back surface of the door. The shoulder of the second bushing rests against the back surface of the door.

Next a collar with a shaft opening therein is slipped, via its shaft opening, over the distal end of the shaft and is secured to the shaft by a screw that inserts into a screw opening that is provided in the collar approximately perpendicular to the longitudinal axis of the shaft. A shaft opening in the collar is fitted to the shaft, i.e. it is provided with two flattened sides to the shaft opening. The collar is provided with a second groove similar to the groove provided in the proximal end of the lever. The second groove receives the shoulder of the second bushing. The screw is threaded into the screw opening until a tip of the screw engages the shaft, thereby securing the collar to the shaft and capturing the second bushing, door, snap bushing, and washer between the collar and the lever.

A latch mechanism with a shaft opening therein is next slipped onto the shaft, via its shaft opening, and is secured to the shaft by a second screw that inserts into a second screw opening provided in the latch mechanism approximately perpendicular to the longitudinal axis of the shaft. A shaft opening in the latch mechanism is also fitted to the shaft, i.e. it is provided with two flattened sides to the latch mechanism opening. The second screw is threaded into the second screw opening until a tip of the second screw engages the shaft, thereby securing the latch mechanism to the shaft.

The latch mechanism has a circular protrusion on a back or rear side of the latch mechanism by which the latch mechanism attaches to a bus bar. The circular protrusion is provided with a third screw opening that is provided approximately parallel with the longitudinal axis of the shaft but is offset therefrom because the circular protrusion is provided on a distal end of an arm that extends outward approximately perpendicular to the longitudinal axis of the shaft. The circular protrusion is first inserted through a protrusion opening provided in the bus bar for this purpose, and then a third screw is first inserted through a large diameter second washer and bar bushing and then threaded into the third screw opening to secure the latch mechanism to the bus bar. The bar bushing is provided with a cylindrical end that enters the protrusion opening and with a shoulder that abuts the bar.

When inserting the latch mechanism onto the shaft and before the latch mechanism is attached to the bus bar, either a front side of the latch mechanism can face the shaft when the latch mechanism is inserted onto the shaft, as illustrated in FIGS. 2, 3 and 3A, or alternately, a rear side of the latch mechanism can face the shaft, as illustrated in FIG. 2A, when the latch mechanism is inserted onto the shaft. The circular protrusion is provided on the rear side of the latch mechanism and it attaches to the bus bar to operationally link this latch mechanism with other identical latch mechanisms to form the door handle system.

The shaft opening in the latch mechanism is provided with two flattened sides that can align with the two flattened sides of the shaft in two different ways simply by rotating the latch mechanism while keeping the front side of the latch mechanism facing the door. Therefore, when the latch mechanism is facing the door, it can be inserted on the shaft in one of two ways so that the latch mechanism can be employed to fit either right or left hand doors, i.e. it can be inserted directly so that the flattened sides of the latch mechanism coincide with the flattened sides of the shaft or it can be rotated 180 degrees before inserting it on the shaft. In addition, the latch mechanism can be flipped over 180 degrees so that the rear side of the latch mechanism faces the door, as previously described. In this orientation, i.e. with the rear side of the latch mechanism facing the door, the latch mechanism can also be inserted on the shaft in one of two ways, similar to the two different ways the latch mechanism could be inserted on the shaft when the front side of the latch mechanism faced the door.

The latch mechanism is provided with a wedge shaped tongue that extends outward perpendicular from the longitudinal axis of the shaft and is located in a plane that is parallel to a plane in which the arm is located. A longitudinal axis of the tongue forms an obtuse angle of approximately 140 degrees with a longitudinal axis of the arm, with a pointed edge of the wedge facing away from the arm.

A plurality of door handles comprised of lever, and associated latch mechanism pairs along with associated washers bushings and collar, that are all identical to those previously described are secured to the door so that all the door handles are aligned with each other and are attached to the same bus bar which is provided with a protrusion openings therethrough for this purpose. Protrusion openings can easily be made in the bus bar so that the door handles can be spaced apart as desired.

When the door handle system is thus installed in the door, for outward opening doors, the tongue will engage the door frame, as illustrated in FIGS. 2 and 3. However, a tongue receiving bracket is needed for inwardly opening doors, as illustrated in FIGS. 2A and 3A. The tongue receiving bracket is attached to the door frame in association with and for the purpose of being removably engaged by its associated tongue. The tongue receiving bracket is secured to the door frame on the side of the door frame where the latch mechanism is positioned when the door is closed. If the receiving bracket is made of sheet metal for mounting on the back side of the door facing, a reinforcing flange is provided on the receiving bracket to give it extra strength. Because the tongue and receiving bracket are both surface mounted to the inside of the door and door frame, respectively, the latch mechanism can be operated from either side of the door unless the door handle system has been locked in a closed position.

An L-shaped lock bracket with a lock opening provided extending through one leg of the bracket is secured to the front side of the door via a screw in association with one or more of the levers. The lock bracket is preferably provided with a counter-bored hole in its second leg into which a screw inserts to secure the lock bracket to the door facing. The hole is preferably counter-bored so that the head of the screw does not interfere with movement of the lever. Each lock bracket is secured to the door on the same side as the levers and is positioned so that the lock opening provided in the lock bracket is aligned with an associated lock opening provided in a distal end of the lever. When the two lock openings are aligned with each other, i.e. the two lock openings are aligned with each other only when the tongue is in its latched position, a link of a padlock can be insert through the two aligned lock openings, thereby locking the door handle system in its closed or latched position. In order to unlock the door handle system, the padlock is removed and then the levers are free to rotate to unlatch the tongues from their associated receiving brackets or door frames, thereby unlatching the door from its door frame. It should be obvious that because all of the levers and latch mechanisms of a given door handle system operated in conjunction with each other, all levers and latch mechanisms are rendered inoperative when any one of the levers is locked.

The arm of each latch mechanism is provided with an ear to prevent the latch mechanism from overextending when it is opened. The ear has an ear surface that positioned approximately perpendicular to a vertical lip provided on the bus bar whenever the latch mechanism is in its latched position. The ear surface engages the vertical lip when the latch is in its fully opened position, thereby preventing the latch mechanism from accidentally being rotated further than its fully opened position.

DETAILED DESCRIPTION OF THE PREFERRED EMBODIMENT

Invention

Figure 1:
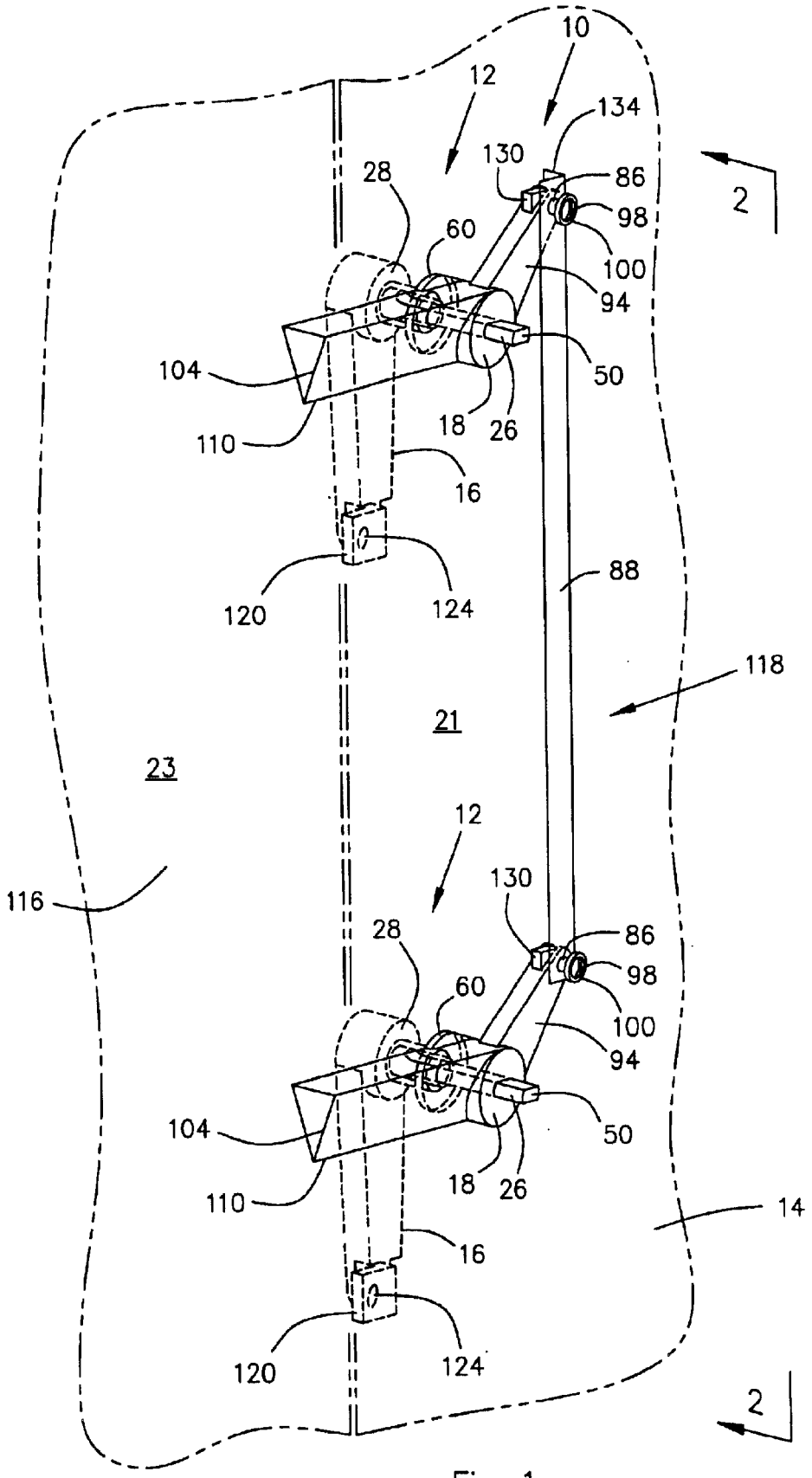
FIG. 1 is a perspective rear view of a door handle system constructed in accordance with a preferred embodiment of the present invention shown in use on an outwardly swinging door.

Referring now to the drawings and initially to FIG. 1, there is illustrated a door handle system 10 that is constructed in accordance with a preferred embodiment of the present invention. Although for ease of illustration and description, only two door handles 12 are illustrated in the door handle system 10 shown in FIG. 1, the invention is not so limited. The door handle system 10 attaches to a door 14 and employs a plurality of handles in the form of levers 16 for simultaneously latching and unlatching a plurality of associated latch mechanisms 18. This system 10 is mounted externally to the front and back surfaces 20 and 21, respectively, of the door 14 and the back surface 23, respectively, of the door frame 24 so that the entire system 10 is readily visible and accessible for repair.

Figure 6:
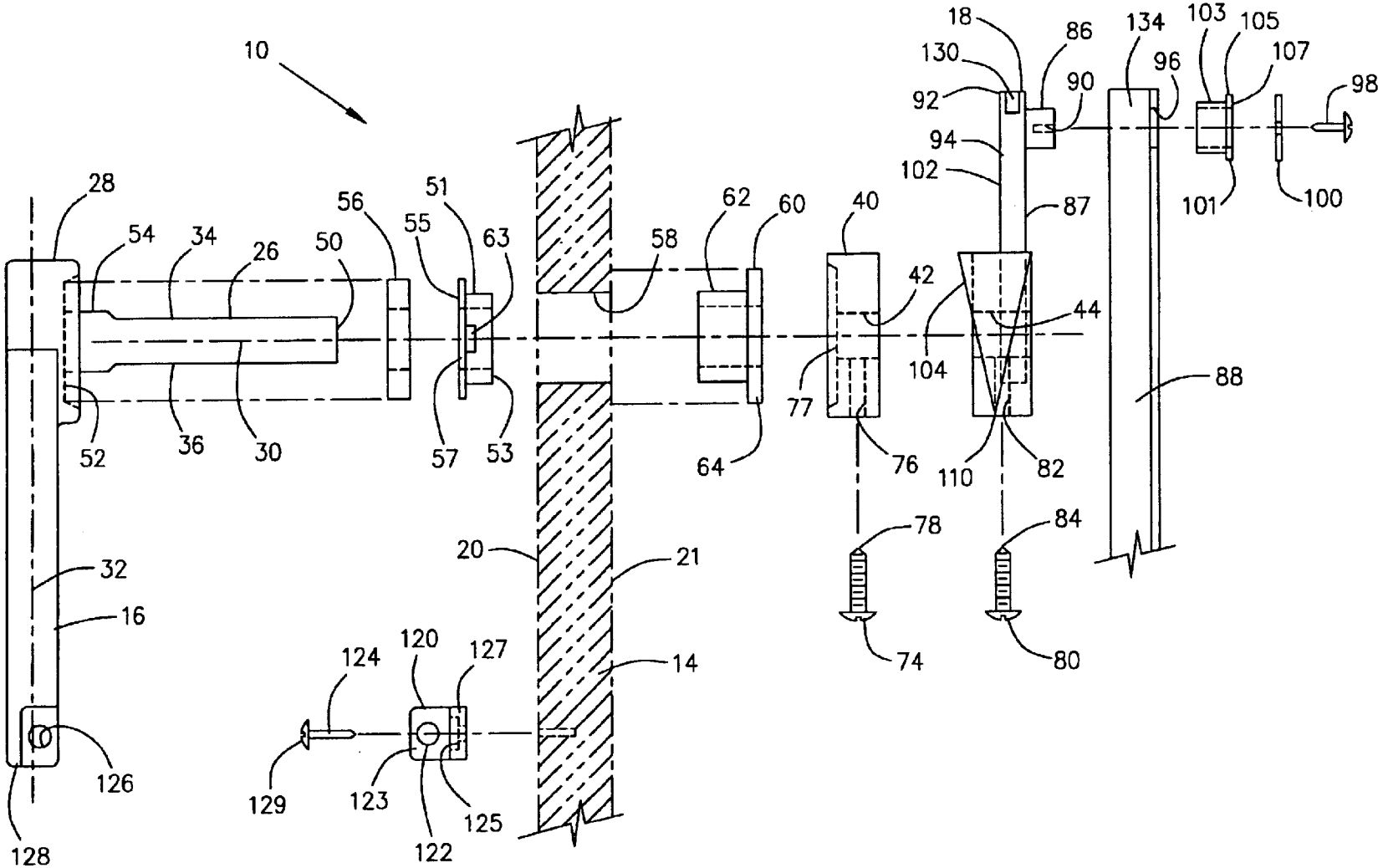
FIG. 6 is an exploded view of a single door handle of the door handle system shown in association with a door.

Referring now to FIG. 6, each lever 16 is paired with and attached to an associated latch mechanism 18 so that the latch mechanism 18 rotates in conjunction with its associated lever 16. Each door handle 12 for the present system 10 is comprised of a lever 16, its associated latch mechanism 18, associated washers 56 and 100, associated bushings 51, 60, and 101, associated collar 40, and associated screws 74, 80, and 98, as will be more fully described hereafter.

Figure 8:
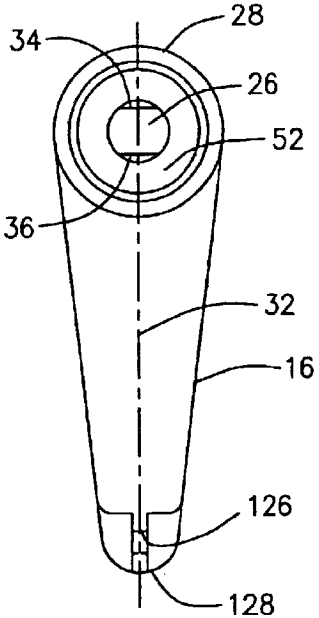
FIG. 8 is a rear view taken along line 8—8 of FIG. 7.
Figure 7:
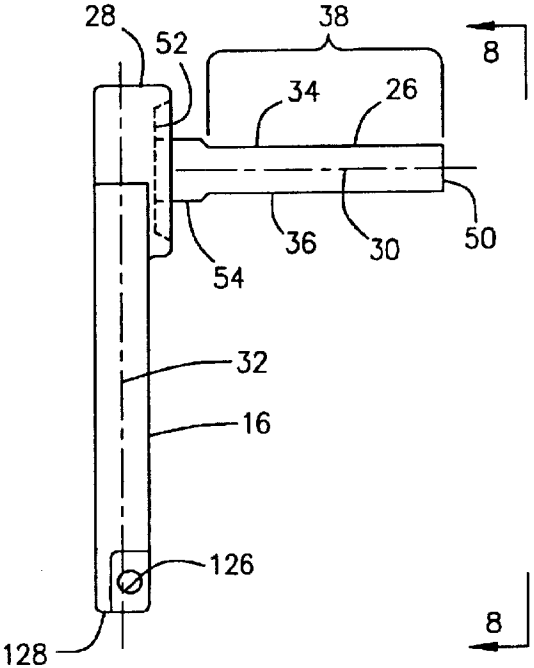
FIG. 7 is a side view of a lever of the door handle system.

As shown in more detail in FIGS. 7 and 8, each lever 16 is provided with a shaft 26 that attaches on a proximal end 28 of the lever 16. The shaft 26 extends outward from the lever 16 so that a longitudinal axis 30 of the shaft 26 is approximately perpendicular to a longitudinal axis 32 of the lever 16. Two opposite sides 34 and 36 of the shaft 26 are flattened along the length 38 of the shaft 26. The purpose of the flattened sides 34 and 36 is so that the collar 40 and latch mechanism 18, both of which are provided with shaft openings, 42 and 44 respectively, therein that are fitted to the shape of the shaft 26. This means that each opening 42 and 44 has two flattened sides 46 and 48, and therefore, neither the collar 40 or the latch mechanism 18 will rotate relative to the shaft 26 when they are slipped over the distal end 50 of the shaft 26, but they will instead rotate in conjunction with rotation of the shaft 26 and its attached lever 16.

Figure 10:
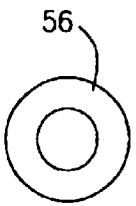
FIG. 10 is a rear view taken along line 10—10 of FIG. 9.
Figure 9:
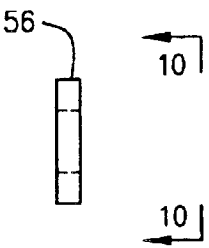
FIG. 9 is a side view of a first washer of the door handle system.

A groove 52 is provided in the proximal end 28 of the lever 16 so that the groove 52 surrounds the proximal end 54 of the shaft 26. A first washer 56 slips over the distal end 50 of the shaft 26 and is partially received within the groove 52. The first washer 56 is preferably compressible so that it seals to the lever 16 and the door 14 to prevent air leakage between the door 14 and the lever 16. The first washer 56 is shown in detail in FIGS. 9 and 10.

Figure 21:
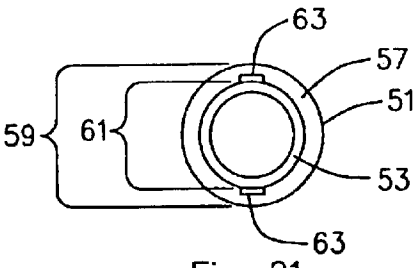
FIG. 21 is a rear view taken along line 21—21 of FIG. 20.
Figure 17:
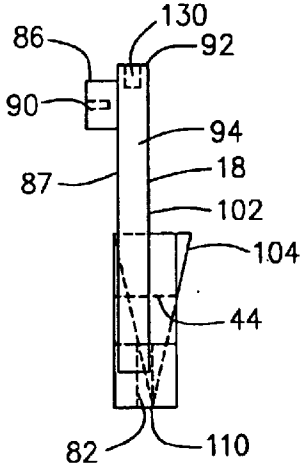
FIG. 17 is an opposite side view taken along line 17—17 of FIG. 15.
Figure 18:
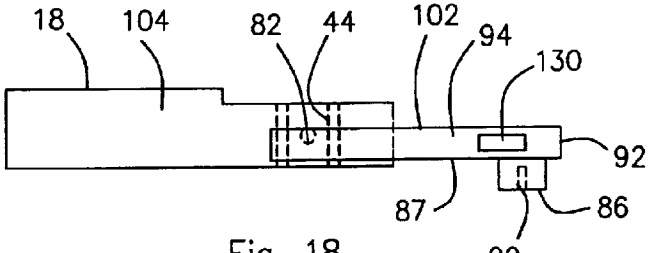
FIG. 18 is a top plan taken along line 18—18 of FIG. 15.
Figure 15:
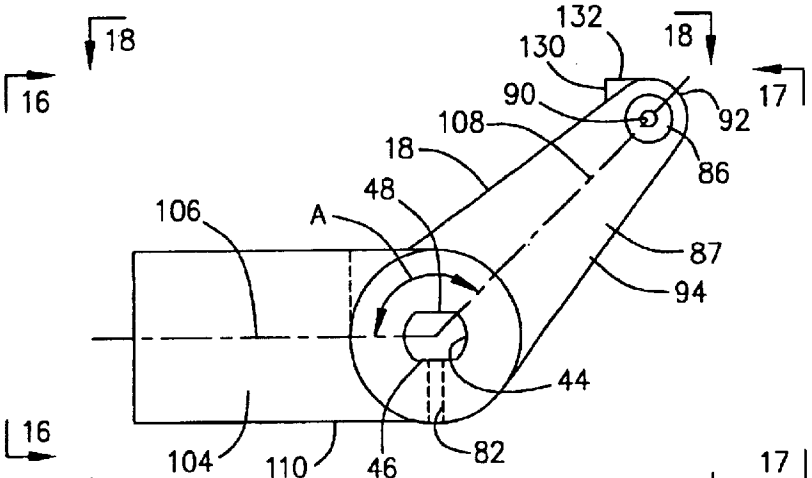
FIG. 15 is a rear view of a latch mechanism of the door handle system.
Figure 19:
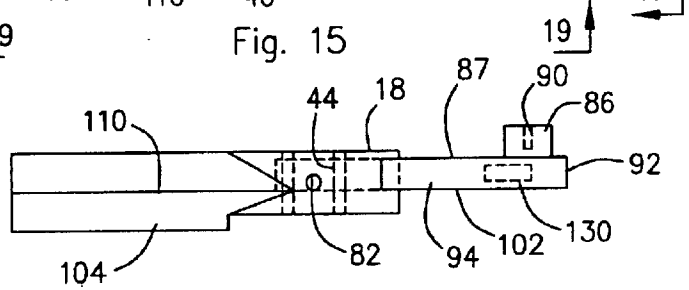
FIG. 19 is a bottom plan taken along line 19—19 of FIG. 15.
Figure 20:
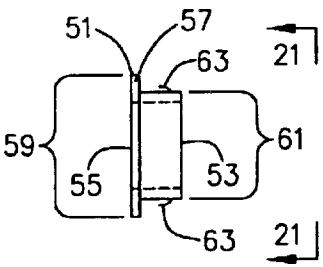
FIG. 20 is a side view of a snap bushing of the door handle system.
Figure 16:
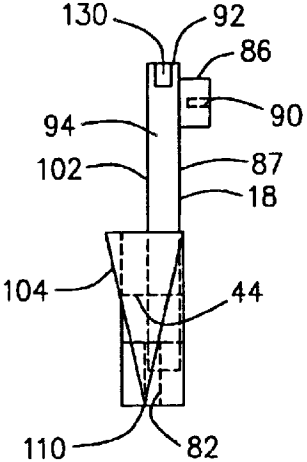
FIG. 16 is a side view taken along line 16—16 of FIG. 15.

Next, a hollow snap bushing 51 is placed over the distal end 50 of the shaft 26 so that a cylindrical end 53 of the snap bushing 51 faces away from the lever 16. The snap bushing 51 is illustrated in detail in FIGS. 20 and 21. An opposite end 55 of the snap bushing 51 is provided with a shoulder 57 which has a larger diameter 59 than a diameter 61 of the cylindrical end 53. Then the shaft 26 is inserted through a handle opening 58 provided in the door 14 for this purpose, and the cylindrical end 53 of the snap bushing 51 enters the handle opening 58 and is secured therein by wings 63 that are provided on the cylindrical end 53, with the shoulder 57 resting against the front surface 20 of the door 14.

Figure 11:
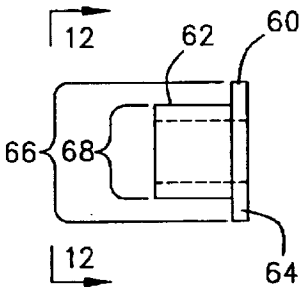
FIG. 11 is a side view of a second bushing of the door handle system.
Figure 12:
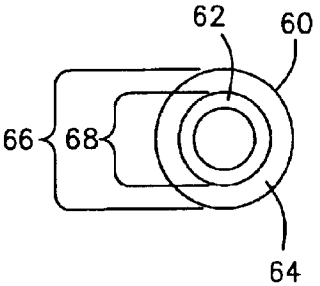
FIG. 12 is a front view taken along line 12—12 of FIG. 11.

After the shaft 26 has been inserted through the handle opening 58 in the door 14, a hollow second bushing 60 inserts over the distal end 50 of the shaft 26 so that a cylindrical portion 62 of the second bushing 60 extends through the handle opening 58 in the door 14. The second bushing 60, as illustrated in FIGS. 11 and 12, is provided with a shoulder 64 that has a larger diameter 66 than the diameter 68 of the cylindrical portion 62, and this shoulder 64 engages the back surface 21 of the door 14. Thus, the shaft 26 extends from a front side 72 of the door 14 to a back side 70 of the door 14 via handle opening 58.

Figure 13:
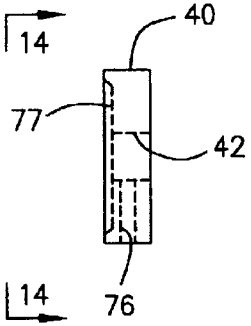
FIG. 13 is a side view of a collar of the door handle system.
Figure 14:
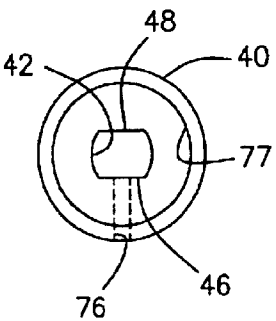
FIG. 14 is a front view taken along line 14—14 of FIG. 13.

Next, the collar 40, illustrated in detail in FIGS. 13 and 14, is slipped over the distal end 50 of the shaft 26 via its shaft opening 42 and is secured to the shaft 26 by a first screw 74 that inserts into a first screw opening 76 provided in the collar 40 approximately perpendicular to the longitudinal axis 30 of the shaft 26. As previously described, the shaft opening 42 in the collar 40 is fitted to the shaft 26, i.e. it is provided with two flattened sides 46 and 48 that engage the two flattened sides 34 and 36 of the shaft 26 as the collar 40 is slipped onto the distal end 50 of the shaft 26. The collar 40 is provided with a second groove 77 similar to the groove 52 provided in the proximal end 28 of the lever 16. The second groove 77 receives the shoulder 64 of the second bushing 60. The first screw 74 is threaded into the first screw opening 76 until a tip 78 of the first screw 74 engages the shaft 26, thereby securing the collar 40 to the shaft 26 and capturing the second bushing 60, the door 14, the snap bushing 51, and the first washer 56 between the collar 40 and the lever 16.

The shaft opening 44 of the latch mechanism 18 is next slipped onto the distal end 50 of the shaft 26. The latch mechanism 18 is illustrated in FIGS. 15–19. The latch mechanism 18 is secured to the shaft 26 by a second screw 80 that inserts into a second screw opening 82 provided in the latch mechanism 18 approximately perpendicular to the longitudinal axis 30 of the shaft 26.

Because the latch mechanism 18 is secured to the shaft 26 with the second screw 80 that can engage the shaft 26 anywhere along the length of the shaft 26 and because the shaft 26 can be made so that it is several inches in length, by simply adjusting the position of the latch mechanism 18 along the shaft 26 the door handle 12 can be used to accommodate doors 14 that are very thin or very thick.

As also previously described, the shaft opening 44 in the latch mechanism 18 is fitted to the shaft 26, i.e. it is provided with two flattened sides 46 and 48 that engage the flattened sides 34 and 36 of the shaft 26 when the latch mechanism 18 is slipped onto the distal end 50 of the shaft 26. The second screw 80 is threaded into the second screw opening 82 until a tip 84 of the second screw 80 engages the shaft 26, thereby securing the latch mechanism 18 to the shaft 26.

The latch mechanism 18 has a circular protrusion 86 provided on and extending outward from a rear side 87 of the latch mechanism 18 by which the latch mechanism 18 is attached to a bus bar 88. The circular protrusion 86 is provided with a third screw opening 90 therein that is approximately parallel with the longitudinal axis 30 of the shaft 26 but is offset therefrom because the circular protrusion 86 is provided on a distal end 92 of an arm 94 of the latch mechanism 18 that extends outward approximately perpendicular to the longitudinal axis 30 of the shaft 26.

As shown in the drawings, the arm 94 is offset from the tongue 104. This offset positioning is important because it allows the latch mechanism 18 to be used with its front side 102 facing the door 14, or alternately, flipped over so that its rear side 87 faces the door 14.

The circular protrusion 86 is first inserted through a protrusion opening 96 created in the bus bar 88 for this purpose. Then a third screw 98 is first inserted through a large diameter second washer 100, next through a bar bushing 101, and then threaded into the third screw opening 90 to secure the latch mechanism 18 to the bus bar 88. The bar bushing 101 is provided with a cylindrical end 103 that enters the protrusion opening 96 and receives internally the circular protrusion 86, and the bar bushing 101 is provided with a shoulder 105 on an opposite end 107 that abuts the bus bar 88.

Figure 3:
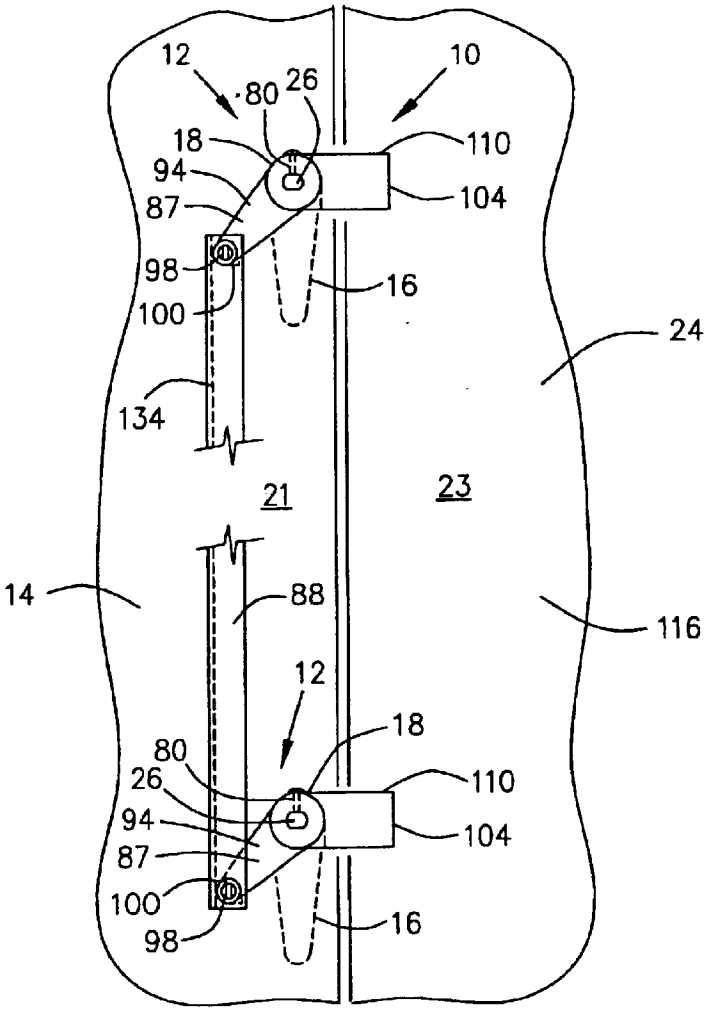
FIG. 3 is a rear view similar to FIG. 2 showing the door handle system in use on an outwardly swinging door that opens in a direction opposite to the direction of opening of the door illustrated in FIGS. 1 and 2.
Figure 2:
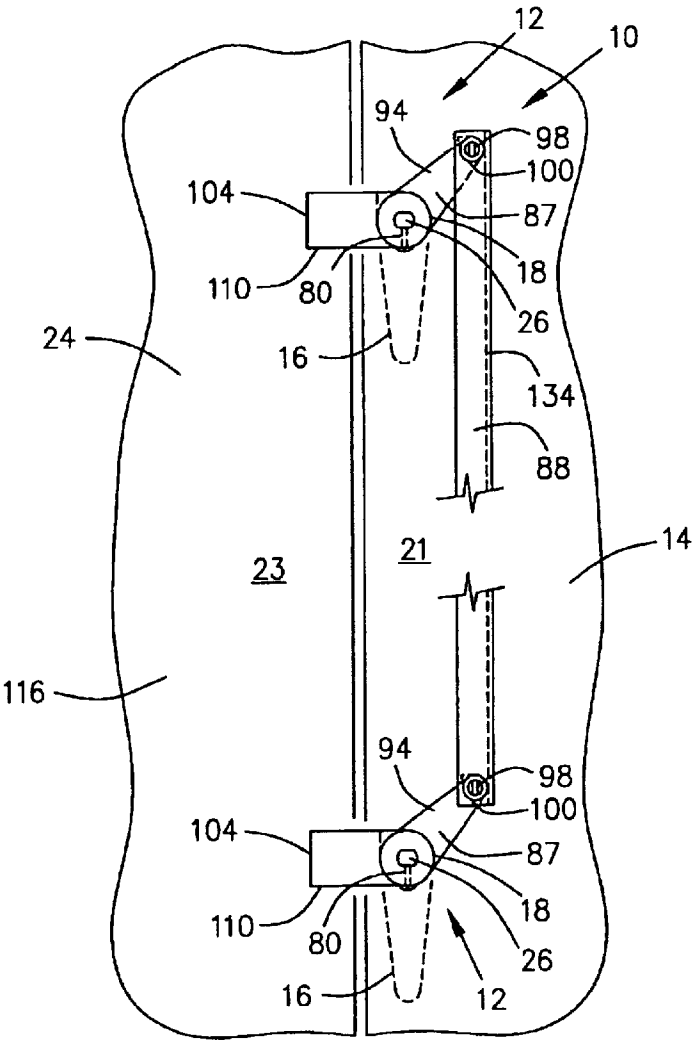
FIG. 2 is a rear view taken along line 2—2 of FIG. 1 showing the door handle system in use with an outwardly swinging door.
Figure 3A:
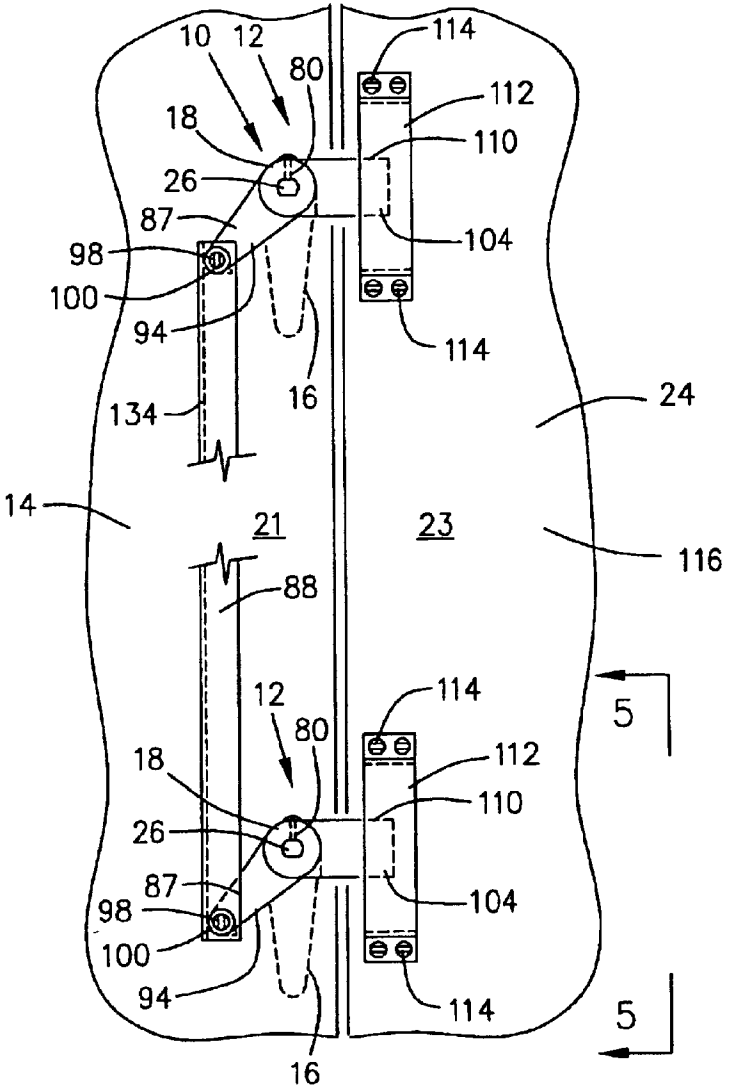
FIG. 3A is a rear view of the same door handle system in use on an inwardly swinging door this is swung from the same side of the door frame as the door illustrated in FIG. 3.
Figure 2A:
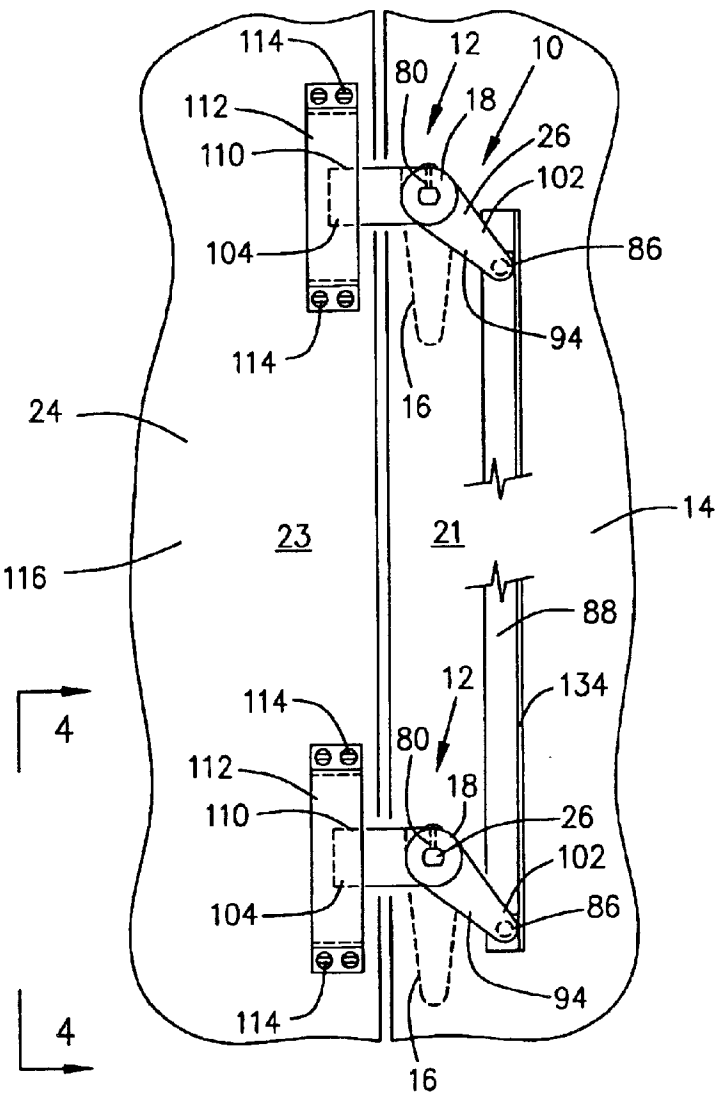
FIG. 2A is a rear view of the same door handle system in use on an inwardly swinging door that is swung from the same side of the door frame as the door illustrated in FIG. 2.
Figure 5:
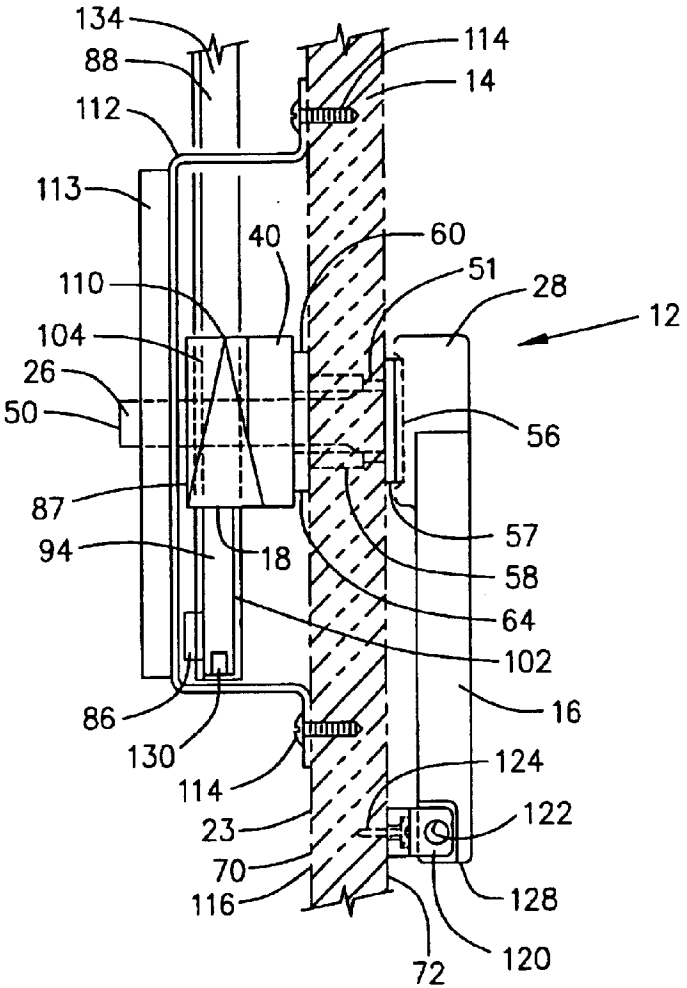
FIG. 5 is a cross sectional view taken along line 5—5 of FIG. 3A.
Figure 4:
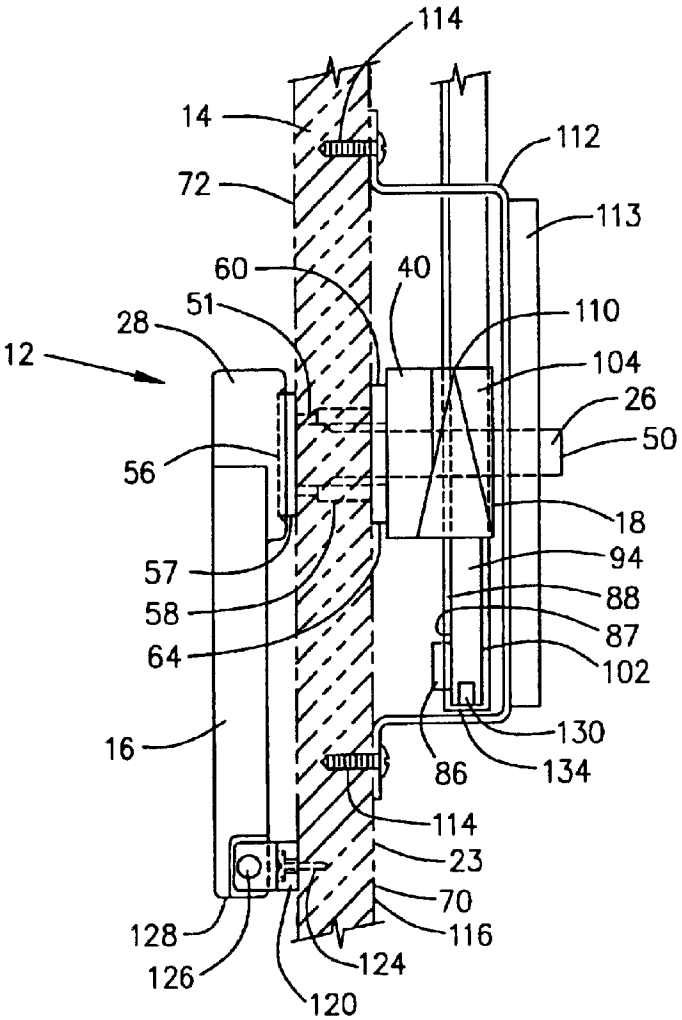
FIG. 4 is a cross sectional view taken along line 4—4 of FIG. 2A.

When inserting the latch mechanism 18 onto the shaft 26 and before the latch mechanism 18 is attached to the bus bar 88, either a front side 102 of the latch mechanism 18 can face faces the shaft 26 when the latch mechanism 18 is inserted onto the shaft 26, as illustrated in FIGS. 2, 3 and 3A, or alternately, a rear side 87 of the latch mechanism 18 can face the shaft 26, as illustrated in FIG. 2A, when the latch mechanism 18 is inserted onto the shaft 26. The circular protrusion 96 is provided on the rear side 87 of the latch mechanism 18 and it attaches to the bus bar 88 to operationally link the latch mechanism 18 of this door handle 12 to the latch mechanisms 18 of all of the other identical door handles 12 of the door handle system 10.

The shaft opening 44 in the latch mechanism 18 is provided with two flattened sides 46 and 48 that can align with the two flattened sides 34 and 36 of the shaft 26 in two different ways simply by rotating the latch mechanism 18 while keeping the front side 102 of the latch mechanism 18 facing the door 14. Therefore, when the latch mechanism 18 is facing the door 14, it can be inserted on the shaft 26 in one of two ways so that the latch mechanism 18 can be employed to fit either right or left hand doors 14, i.e. it can be inserted directly so that the flattened sides 46 and 48 of the shaft opening 44 of the latch mechanism 18 coincide with the flattened sides 34 and 36, respectively, of the shaft 26. Alternately, the latch mechanism 18 can be rotated 180 degrees before inserting it on the shaft 26 so that flattened sides 46 and 48 align, respectively, with sides 36 and 34, respectively. In addition, the latch mechanism 18 can be flipped over 180 degrees so that the rear side 87 of the latch mechanism 18 faces the door 14, as previously described. In this orientation, i.e. with the rear side 87 of the latch mechanism 18 facing the door 14, the latch mechanism 18 can also be inserted on the shaft 26 in one of two ways, similar to the two different ways the latch mechanism 18 could be inserted on the shaft 26 when the front side 102 of the latch mechanism 18 faced the door 14.

The latch mechanism 18 is provided with a wedge shaped tongue 104 that extends outward approximately perpendicular to the longitudinal axis 30 of the shaft 26 and is located in a plane parallel to a plane in which the arm 94 is located. A longitudinal axis 106 of the tongue 104 forms an obtuse angle, identified on the drawing as angle "A", of approximately 140 degrees with a longitudinal axis 108 of the arm 94. A pointed edge 110 of the wedge-shaped tongue 104 points away from the arm 94.

A plurality of door handles 12, each identical to door handle 12 previously described herein, are secured to the door 14 so that all the door handles 12 are aligned with each other and are attached to the same bus bar 88 into which properly spaced protrusion openings 96 have been created for this purpose. Protrusion openings 96 are drilled into the bus bar 88 so that the door handles 12 can be spaced apart as desired.

When the door handle system 10 is thus installed in the door 12, for outward opening doors 12, the tongue 104 will engage the door frame 24, as illustrated in FIGS. 2 and 3. However, a tongue receiving bracket 112 is needed for inwardly opening doors 12, as illustrated in FIGS. 2A and 3A. A tongue receiving bracket 112 is not necessary on outwardly opening doors 14 as the tongue 104 simply engages the door frame 24 to latch the door 14 closed. The tongue receiving bracket 112 is attached to the door frame 24 in association with and for the purpose of being removably engaged by its associated tongue 104. The tongue receiving bracket 112 is secured to the door frame 24 via screws 114 or other suitable fasteners so that the tongue receiving bracket 112 is on the back surface 23 of the back side 116 of the door frame 24 where the latch mechanism 18 is positioned when the door 14 is closed. If the tongue receiving bracket 112 is made of sheet metal, an outwardly extending flange 113 is provided on the tongue receiving bracket 112 to strengthen it against bending. Because the tongue 104 and the tongue receiving bracket 112 are both surface mounted, i.e. surface mounted respectively to the back side 70 of the door 14 and to the back side 116 of the door frame 24, the latch mechanism 18 can be operated from either side of the door 14, i.e. the front side 72 or the back side 70, unless, of course, the door handle system 10 has been locked in a closed position 118. Also, employing this door handle system 10, the door 14 can be opened either inwardly or outwardly and can be opened from either the left or right side.

An L-shaped lock bracket 120 with a lock opening 122 provided extending through one leg 123 of the lock bracket 120 is secured to the front side 72 of the door 14 via a lock screw 124 or other suitable fastener in association with at least one of the levers 16. The lock bracket 120 is preferably provided with a counterbored hole 125 in its second leg 127 into which the lock screw 124 inserts to secure the lock bracket 120 to the door 14. The hole 125 is preferably counterbored so that a head 129 of the lock screw 124 is recessed within the lock bracket 120 and does not interfere with movement of the lever 16.

Each lock bracket 120 is secured to the door 14 on the same side of the door 14, i.e. the front side 72, where the levers 16 are located when the door 14 is in its closed position 118. Each lock bracket 120 is positioned so that the lock opening 122 provided in the lock bracket 120 is aligned with an associated lock opening 126 provided in a distal end 128 of the lever 16. When the two associated lock openings 122 and 126 are aligned with each other, i.e. when the tongue 104 is in its closed or latched position 118, a link of a padlock (not illustrated) can be inserted through the two aligned lock openings 122 and 126, thereby locking the door handle system 10 in its closed or latched position 118. Also, when the lever 16 is in its locked position, the lever 16 covers the lock screw 124, thereby preventing the lock bracket 120 from being removed from the door 14 in an effort to unlock the door handle system 10 without removing the padlock from the two aligned lock openings 122 and 126.

In order to unlock the door handle system 10, the padlock is removed from the lock openings 122 and 126 and then the levers 16 are free to rotate to thereby unlatch the tongues 104 from their associated tongue receiving brackets 112, thereby unlatching the door 14 from its door frame 24. It should be obvious that because all of the levers 16 and latch mechanisms 18 of a given door handle system 10 operated in conjunction with each other, all levers 16 and latch mechanisms 18 are rendered inoperative when any one of the levers 16 is locked.

The arm 94 of each latch mechanism 18 is provided with an ear 130 to prevent the latch mechanism 18 from over-extending or rotating too far when it is opened. The ear has 130 an ear surface 132 that is approximately perpendicular to a vertical lip 134 provided on the bus bar 88 when the latch mechanism 18 is in its latched position 118. The ear surface 132 engages the vertical lip 134 when the latch mechanism 18 is fully opened; thereby preventing the latch mechanism 18 from accidentally being rotated further than it's fully opened position.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A door handle assembly comprising:

a plurality of handles, each handle provided with a shaft, a latch mechanism attached to each said shaft so that each shaft extends through a handle opening of a door and the latch mechanism and associated handle are on opposite sides of the door and said handle and latch mechanism rotate in unison with each other, each said latch mechanism provided with an arm that attaches to a common bus bar so that all the latch mechanisms work in unison, each said latch mechanism provided with a tongue for engaging a door frame for the door as a means of latching the door shut, a longitudinal axis of each shaft is approximately perpendicular to a longitudinal axis of its associated handle, each arm is provided on its associated latch mechanism so that a longitudinal axis of the arm is approximately perpendicular to the longitudinal axis of the shaft, each tongue is provided on its associated latch mechanism so that a longitudinal axis of the tongue forms an obtuse angle with the longitudinal axis of its associated arm, the longitudinal axis of the tongue is approximately perpendicular to the longitudinal axis of the shaft, and the longitudinal axis of the tongue is located in a plane that is approximately parallel to a plane in which the arm is located.

2. A door handle assembly comprising:

a plurality of levers, each lever provided on one end with a shaft for extending through a handle opening in a door, a bushing for each shaft to allow the shaft to rotate within the handle opening of the door, a collar engaging each shaft to hold the shaft within the handle opening of the door, a latch mechanism attached to each shaft on an opposite side of the door from its associated lever so that each latch mechanism rotates in conjunction with its associated lever, each latch mechanism provided with an outwardly extending tongue for engaging a door facing to latch the door shut, each latch mechanism provided with an outwardly extending arm, each arm attached to a common bus bar to functionally connect all of the arms together so that they rotate in unison, a snap bushing provided on one side of the door so that a cylindrical end of the snap bushing extends into the handle opening and wings provided on the cylindrical end engaging the handle opening of the door to hold the snap bushing within the handle opening, and a second bushing with a cylindrical portion that extends into the handle opening of the door from an opposite side of the door from the snap bushing.

* * * * *